United States Patent [19]

Pols

[11] 4,445,352

[45] May 1, 1984

[54] RIM FORMER

[75] Inventor: Pieter M. Pols, Maasland, Netherlands

[73] Assignee: Machinefabriek A. Fontijne B.V., Netherlands

[21] Appl. No.: 348,711

[22] Filed: Feb. 16, 1982

[30] Foreign Application Priority Data

Mar. 13, 1981 [NL] Netherlands ..... 8101240

[51] Int. Cl.[3] ..... B21H 1/10

[52] U.S. Cl. ..... 72/101; 72/105

[58] Field of Search ..... 72/101, 102, 105, 106, 72/108, 248

[56] References Cited

U.S. PATENT DOCUMENTS 321,165 6/1885 Wheeler ..... 72/101
1,629,703 5/1927 Higgins .
2,935,113 5/1960 Gollwitzer ..... 72/101
3,046,819 7/1962 Miller .

FOREIGN PATENT DOCUMENTS 1281404 7/1972 United Kingdom ..... 72/248

*Primary Examiner*—Lowell A. Larson
*Attorney, Agent, or Firm*—Scully, Scott, Murphy & Presser

[57] ABSTRACT

A rim forming apparatus, substantially comprising a frame having two superimposed drivable and substantially vertically slidable spindles for applying thereon rim forming tools or rolls, the lower spindle being movable by means of a hydraulic cylinder relative to the upper spindle, while the upper spindle is tiltable in the plane through the two spindles for compensating the deflection of the two spindles during the rim forming process, wherein the spindles carrying the rim forming rolls are each received in the one end of a swivelling arm the other end of which is mounted in the frame.

6 Claims, 8 Drawing Figures

RIM FORMER

The invention relates to a rim former substantially comprising a frame having two superimposed, drivable and substantially vertically slidable spindles for applying rim forming tools or rolls thereon, the lower spindle being movable through a hydraulic cylinder relative to the upper spindle, said upper spindle being tiltable in the plane going through both spindles for compensating the deflection of both spindles during the rim forming process.

Rim formers of this type are disclosed in a brochure of the company Grotnes Metal Forming Systems Inc., published in 1980.

When forming rims substantial forces are exerted on the rim forming tools. With rims applied in normal passenger cars, forces are produced in the order of magnitude of 16,000 kg, while with very large rims for e.g. trucks which may have a width of approximately 1 m, forces of about 91,000 kg may be produced. This sets very high requirements to the inherent stability of the frame and the guides for the slides disposed therein, accommodating the slidable spindles. The slide guides in the prior art apparatus are provided by milling in the front and rear wall of the frame. In view of the required inherent stability of the frame, the front and rear wall thereof are formed by very thick steel plates which have to be provided along a substantial length with guide slots. This requires a great many machining hours, and moreover a very large milling machine, since with a view to the required accuracy, the guide slots in the front and rear wall have to be machined preferably in one fixing step. True, the frame can also be machined in parts, but this again requires a great many assembly hours in order to obtain a completely parallel configuration of the left-hand and right-hand guide strip and the guide slot in front and rear wall.

In addition to the substantial machining drawback, the prior art apparatus has the additional drawback that exclusively the upper spindle can be positioned in an inclined position relative to the lower spindle for compensating the deflection of the spindles carrying the rim forming tools as a result of the substantial forces occurring during the forming. The bearing for the upper spindle mounted in the front and rear wall of the frame are adapted for tilting movement for this purpose and the misalignment of the upper spindle takes place by means of two lead screws mounted in the front and rear wall. It has been found that only the misalignment of only the upper tool spindle is insufficient to maintain the rim thickness uniform. Consequently, also an axial adjustment of the tool is necessary.

It is the object of the invention to provide an apparatus wherein these drawbacks are eliminated and it is characterized therefor in that the spindles carrying the rim forming rolls are each accommodated in the one end of a swivelling arm the other end of which is mounted in the frame.

When lifting or lowering the two tool spindles, these describe a circular arc about the bearings of the swivelling arm in the frame. Such a suspension of the spindles carrying the rim forming rolls is completely stable and the guide slots in the front and rear wall of the frame can therefore be omitted.

As a result of the swivelling arm construction, a misalignment of both the upper and the lower spindle can be elegantly ensured. To this effect the bearing of each swivelling arm preferably comprises spherical parts, one of which being received in an eccentric bearing brass, while the other bearing is mounted for axial displacement in the frame. By adjustment of said eccentric bearing brass, the spindle of the swivelling arm comes to lie misaligned in the frame and since the spindles carrying the rim forming rolls are received in the other end of the swivelling arm, also these spindles will come to lie misaligned in the frame for compensating the deflection occurring during the rim forming process.

The eccentric bearing brasses of the swivelling arms are preferably mounted at the end of the swivelling arm facing away from the rim forming roll, so that an easier operation is possible.

In order to adjust both tool spindles simultaneously through an identical but opposite angle, preferably an operating mechanism is provided that is connected to both eccentric bearing brasses.

Said operating mechanism comprises preferably one axially displaceable lead screw, at one end of which there are attached two links which are pivotally connected respectively to the eccentric bearing brasses of the two swivelling arms in such a way that upon axial displacement of the lead screw both eccentric bearing brasses are adjusted through the same angle.

One embodiment of the apparatus according to the invention will now be described, by way of example, with reference to the accompanying drawings, wherein FIG. 1 diagrammatically shows a prior art rim forming apparatus;

Figure 1:
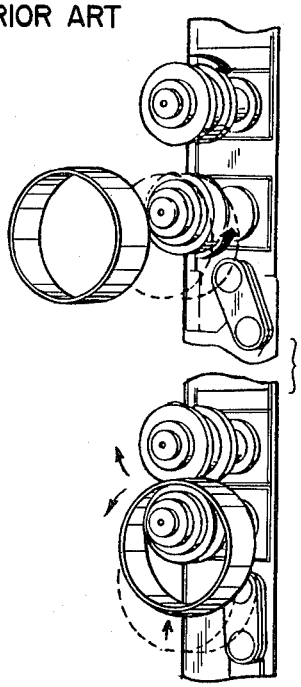
FIG. 1 PRIOR ART
Figure 2:
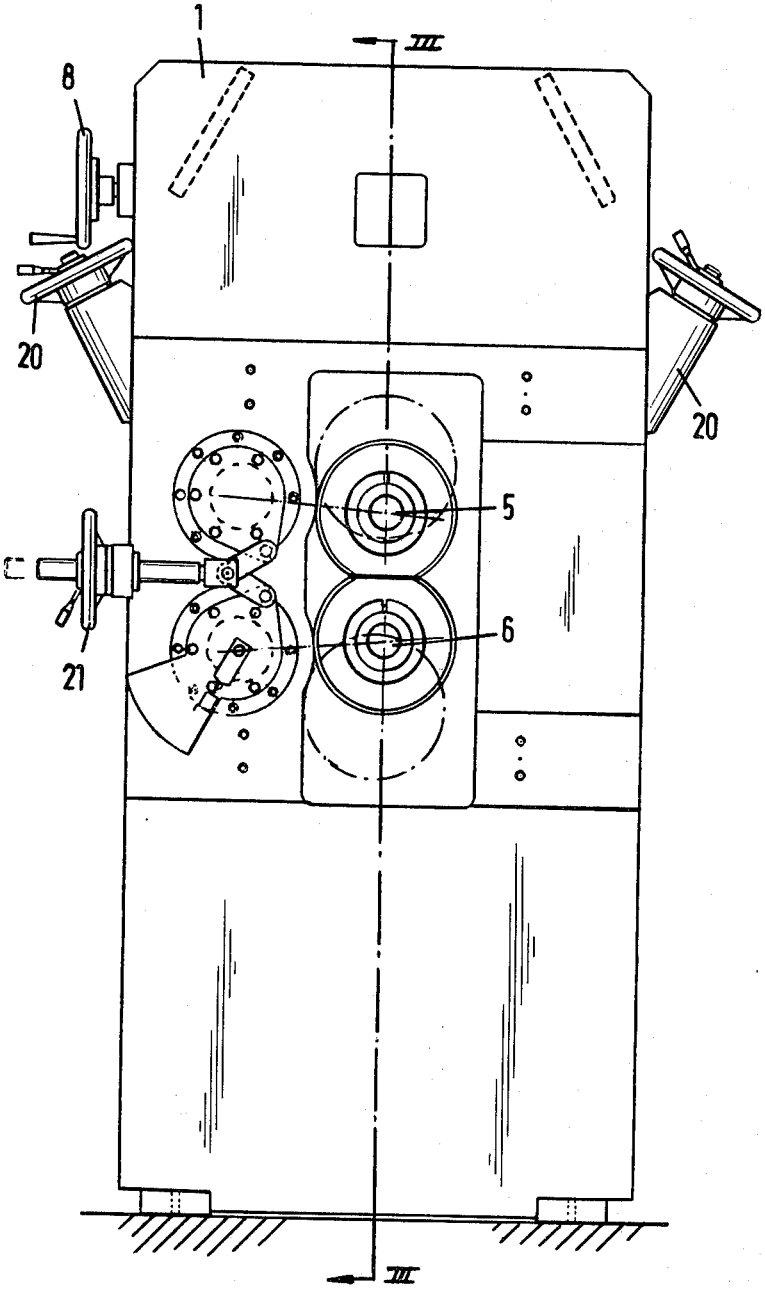
FIG. 2 is a rear view of the apparatus according to the invention with omission of the drive shown in FIG. 3.
Figure 3:
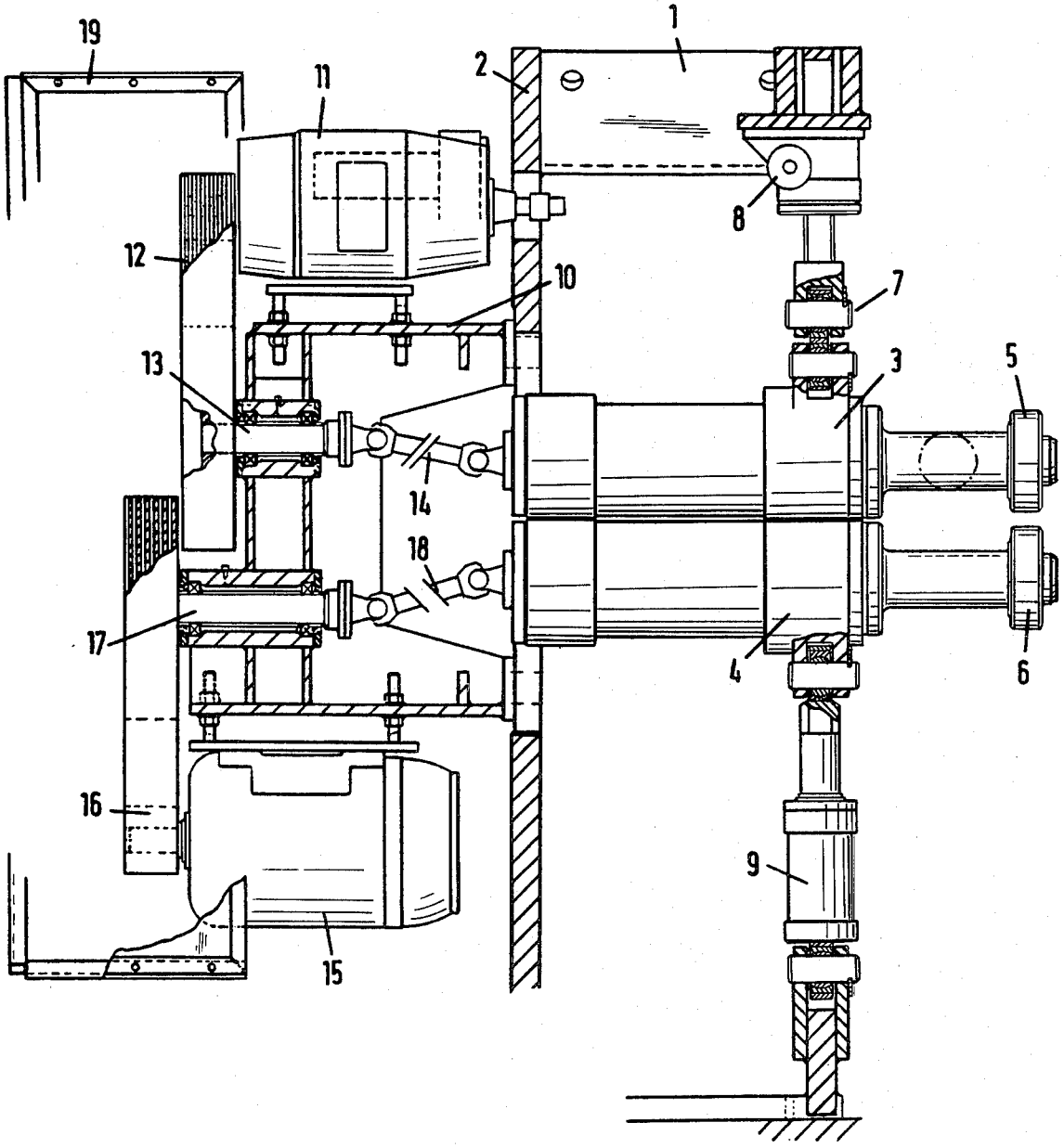
FIG. 3 is a cross-section on the line III—III of FIG. 2.

FIG. 1 diagrammatically shows a known rim forming apparatus having an upper spindle fitted with a rim forming tool and a lower spindle provided with such a tool. A blank, i.e. a cylindrical ring to be formed to a rim, is provided on the lower tool, after which the lower spindle is displaced in upward direction until the two forming tools abut on the rim to be formed. Both tools are subsequently driven in opposite direction, whereby a profile is formed in the rim. The lower tool spindle is uniformly displaced in upward direction during the forming in order to impart the required profile to the rim. The two tool spindles are received in slides mounted in guide slots disposed in the frame The apparatus according to the invention as shown in FIGS. 2–3 comprises a frame 1 having a rear wall 2. The frame accommodates a housing 3 for the upper tool spindle and a housing 4 for the lower tool spindle, wherein are mounted respectively the upper tool spindle 5 and the lower tool spindle 6. The housing 3 for the upper tool spindle is connected through an adjustment mechanism 7 to the frame 1. The adjustment mechanism 7 can be operated through a hand wheel 8 for lifting or lowering the housing 3 for the upper tool spindle. The housing 4 for the lower tool spindle is connected through a hydraulic cylinder 9 to the base of the frame 1.

Figure 8:
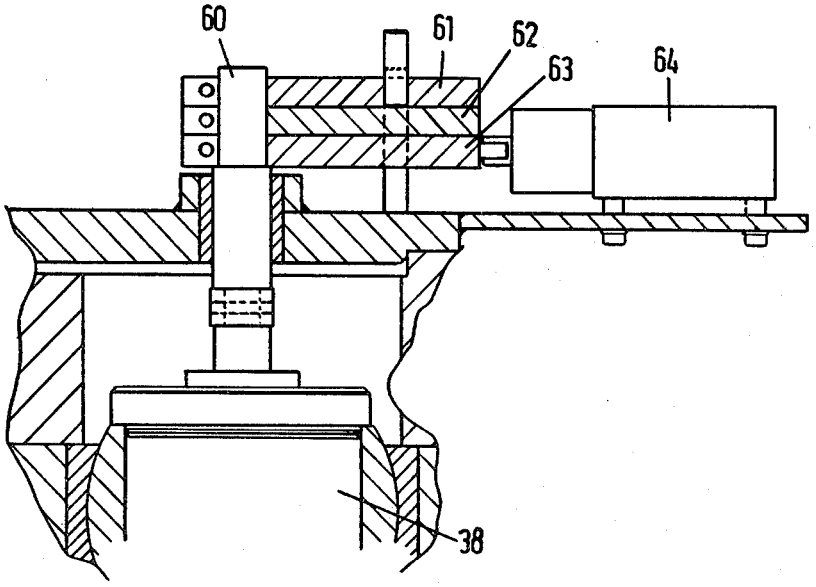
FIG. 8 Is a partial cross-section on the line VIII—VIII in FIG. 6.

On the rear wall 2 of the frame 1 there is mounted a supporting bracket 10 on which a motor 11 is positioned which is adapted to drive through driving belts 12 the drive shaft 13 for the upper tool spindle 5. Between the drive shaft 13 and the tool spindle 5 there is mounted a coupling shaft 14 which is connected through two universal joints on the one end to the drive shaft 13 and on the other end to the tool spindle 5. In the same manner a motor 15 is provided at the bottom of the bracket 10 for driving the shaft 17 through the driving belts 16 for the lower tool spindle 6, while between the drive shaft 17 and the tool spindle 6 there is provided a coupling shaft 18, likewise provided with two universal joints. In this manner shafts 5 and 6 can be driven by motors 11 and 15 irrespective of the position occupied by the shafts 5 and 6. In FIG. 2 numeral 21 indicates the operating mechanism for adjusting the shafts 5 and 6 in inclined position. This operating mechanism 21 will be further explained in FIGS. 6–8. In FIG. 2 are furthermore indicated with dotted lines the outer positions of the shafts 5 and 6, as well as two hand wheels 20 for adjusting side guides, not further shown, which at their ends are provided with rolls that during the application of the profile in the rim, press on said rim in order to prevent the rim from oscillating.

Figure 4:
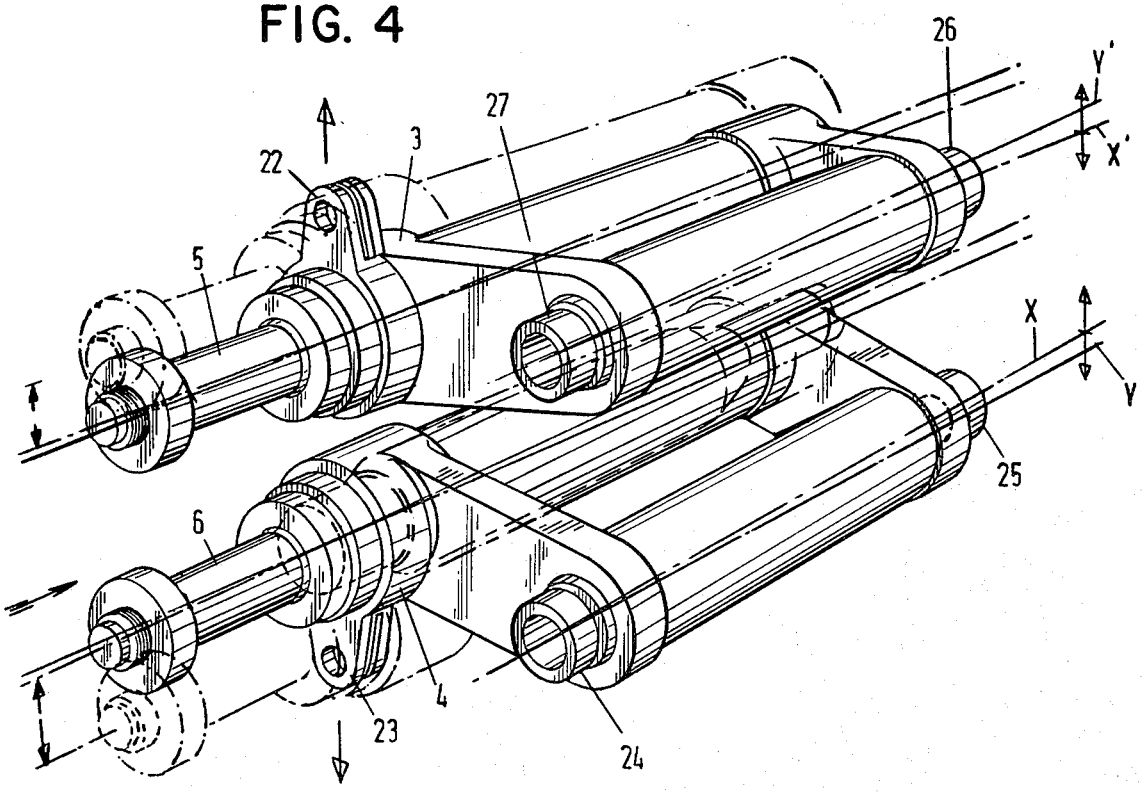
FIG. 4 is an isometric projection of both swivelling arms with the two tool spindles received therein, while the adjustment possibilities are diagrammatically shown.
Figure 5:
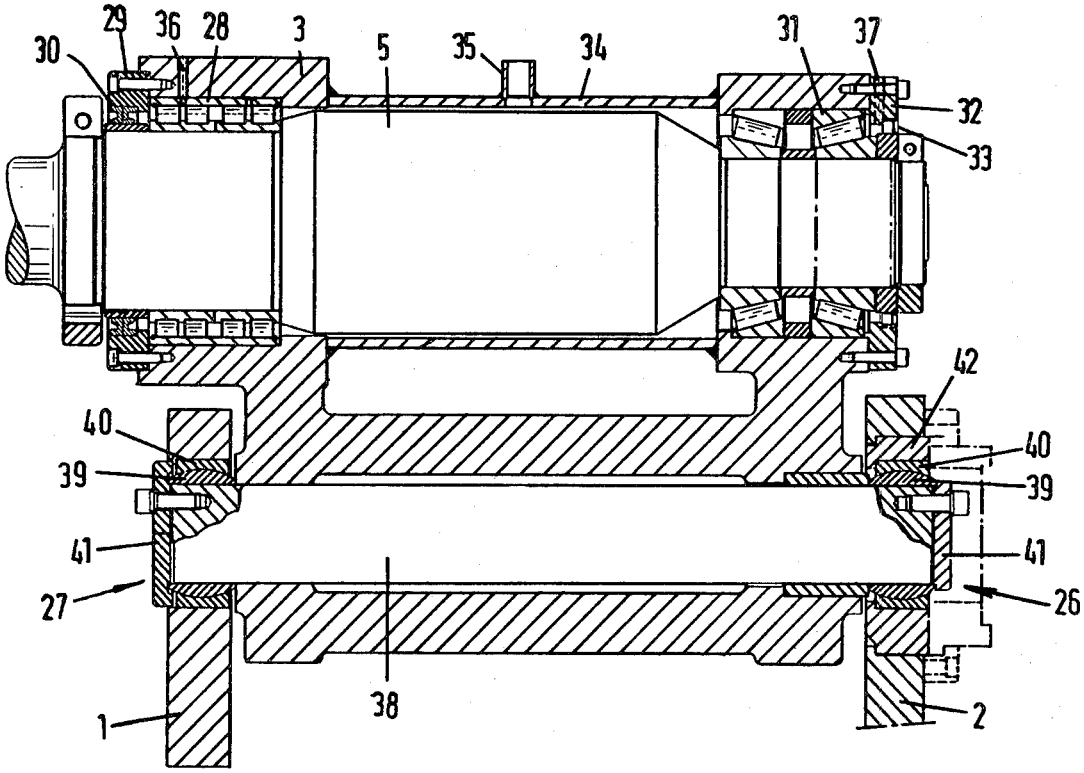
FIG. 5 is a cross-section through a swivelling arm construction.

The swivelling arm construction is clearly shown in FIGS. 4 and 5. The lower tool spindle 6 is mounted in a housing 4 designed as swivelling arm, which housing accommodates a shaft extending parallel to the tool spindle 6, said shaft being mounted at the ends 24, 25 in the frame. On the housing 4 there is provided at 23 an eye for the purpose of connecting the housing 4 to the hydraulic cylinder 9. The lower position of the tool spindle 6 is indicated in dotted lines, in which position the not yet formed rim ring is installed on the tool. Of the two bearings 24, 25, the rearmost bearing 25 is received in an eccentric bearing brass. In the mid-position of said eccentric brass 25 there extends the axis of the swivelling arm axis according to the line indicated by X in the drawing. By rotation of the eccentric bearing brass 25 the axis X will tilt about the stationary bearing 24 in downward direction. The tilted axis X is indicated in the drawing by Y. As a result of said displacement of the axis from the position X to Y, also the forming tool disposed on the shaft 6 will tilt in the same direction, so that the tool will move in upward direction.

The upper tool spindle 5 is received in the same swivelling arm construction 3 as described in the above. At 22 is indicated an eye for connecting the swivelling arm 3 to the adjustment mechanism 7. The swivelling arm shaft is fixedly mounted in the frame at 27 and at 26 said bearing is again received in an eccentric bearing brass. The eccentric bearing brasses 25, 26, true, are identical but oppositely mounted, so that the axis X' of the upper swivelling arm is tilted from a neutral position in upward direction and then occupies the position Y', while the axis X of the swivelling arm 4 can be tilted in downward direction. The swivelling arm construction is shown in more detail in FIG. 5. The swivelling arm construction 3 comprises substantially a fork-like part provided at the front and rear side with recesses for accommodating bearings wherein the tool spindle 5 is mounted. In view of the substantial forces exerted on the tool spindle 5, heavy bearings should be applied both at the front and at the rear side. The front bearing 28 is attached to the housing 3 by means of a retaining plate 29 provided on the spindle 5. The retaining plate 29 accommodates oil seals 30. At the rear side a rear bearing 21 is confined in the housing 3 by means of a retaining plate 32. The retaining plate 32 likewise accommodates an oil seal 33. Between the two legs of the housing 3 there is provided a sealing cylinder 34 having an oil discharge branch 35. In the front housing portion there is provided in situ of the front bearing 28, an oil supply duct 36 and adjacent the rear bearing 31 there is provided an oil supply duct 37 in the retaining plate 32. The tool spindle 5 is thus confined in a completely oil-tight housing portion.

The side of the housing 3 opposite the tool spindle 5 is mounted on a swivel axle 38 provided in the walls 1, 2 of the frame. The swivelling arm 3 consequently is adapted for rotation about the stationary swivel axle 38. The bearing of the axle 38 is of a particular construction both at the front and at the rear side, since the swivel axle 38 should be capable of performing tilting movements in the frame, as explained in the above in FIG. 4. The front bearing 27 comprises a self-adjusting spherical bearing brass 39 received in a concave bearing brass 40. The bearing is secured on the swivel axle 38 by means of a retaining plate 41. The bearing 27 can therefore function as ball joint, while the bearing brass 40 is mounted for axial sliding movements.

The bearing 26 provided in the rear wall 2 of the frame is of an analogous construction as the bearing 27. A self-adjusting spherical bearing brass 39 is provided also in the bearing 26, received in an associated concave bearing brass 40, while the spherical brass 39 is secured on the swivel axle 38 through a retaining plate 41. About the concave bearing brass 40 there is provided an eccentric bearing brass 42 which is adapted for rotation in a chamber provided in the wall 2 of the frame. The axis of the eccentric bearing brass 42, in FIG. 5, lies about 1 cm below the axis of the swivel axle 38. By rotating the eccentric bearing brass 42, the axis of the swivel axle 38 can consequently tilt about the pivot formed by the front bearing 27. Since the tool spindle 5 and the swivel axle 38 are received in the same housing 3, the tool spindle 5 should necessarily follow the tilting movement of the swivel axle 38.

Figure 6:
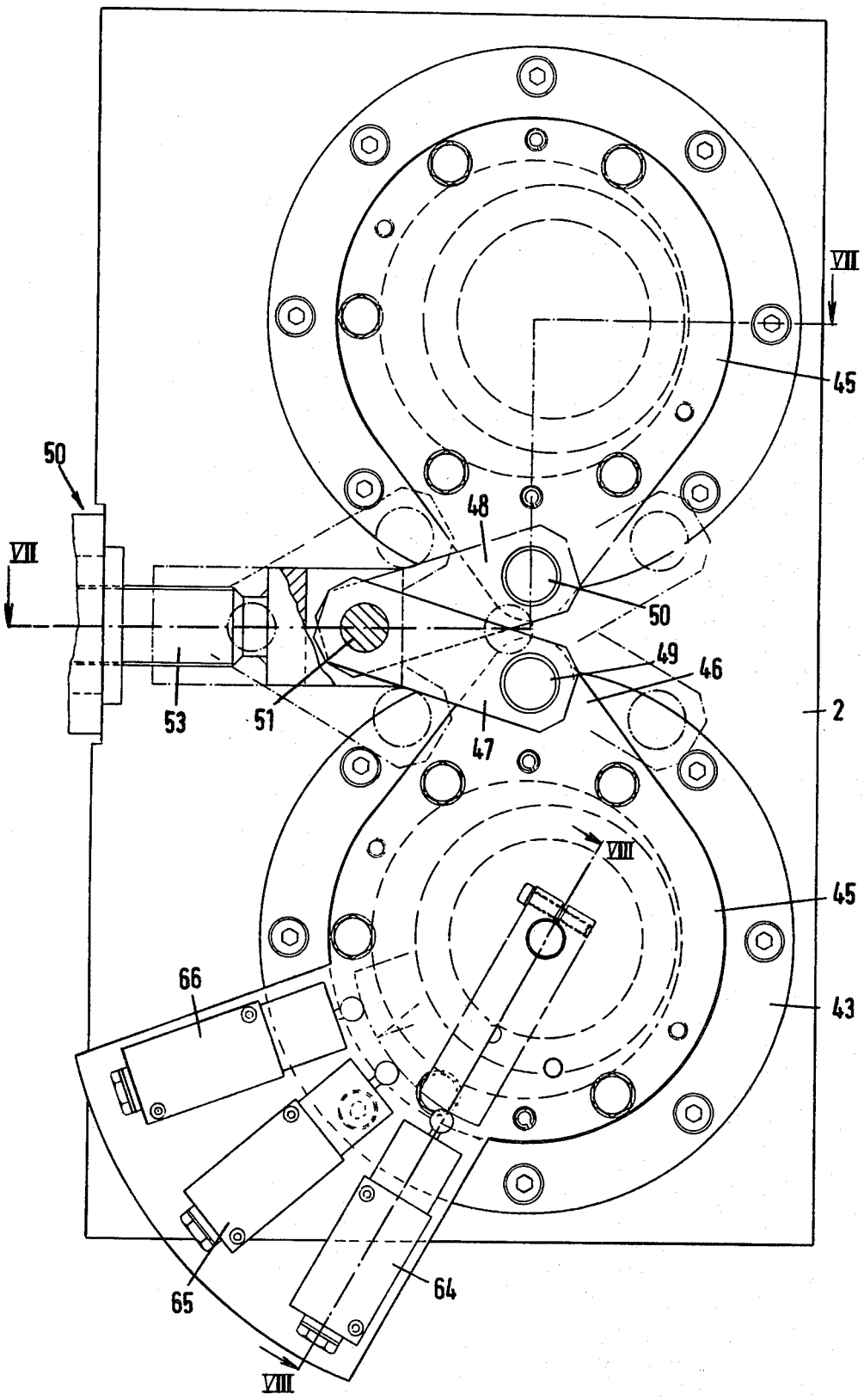
FIG. 6 is a view, partly in cross-section of the operating mechanism for simultaneously adjusting the two swivelling arms.
Figure 7:
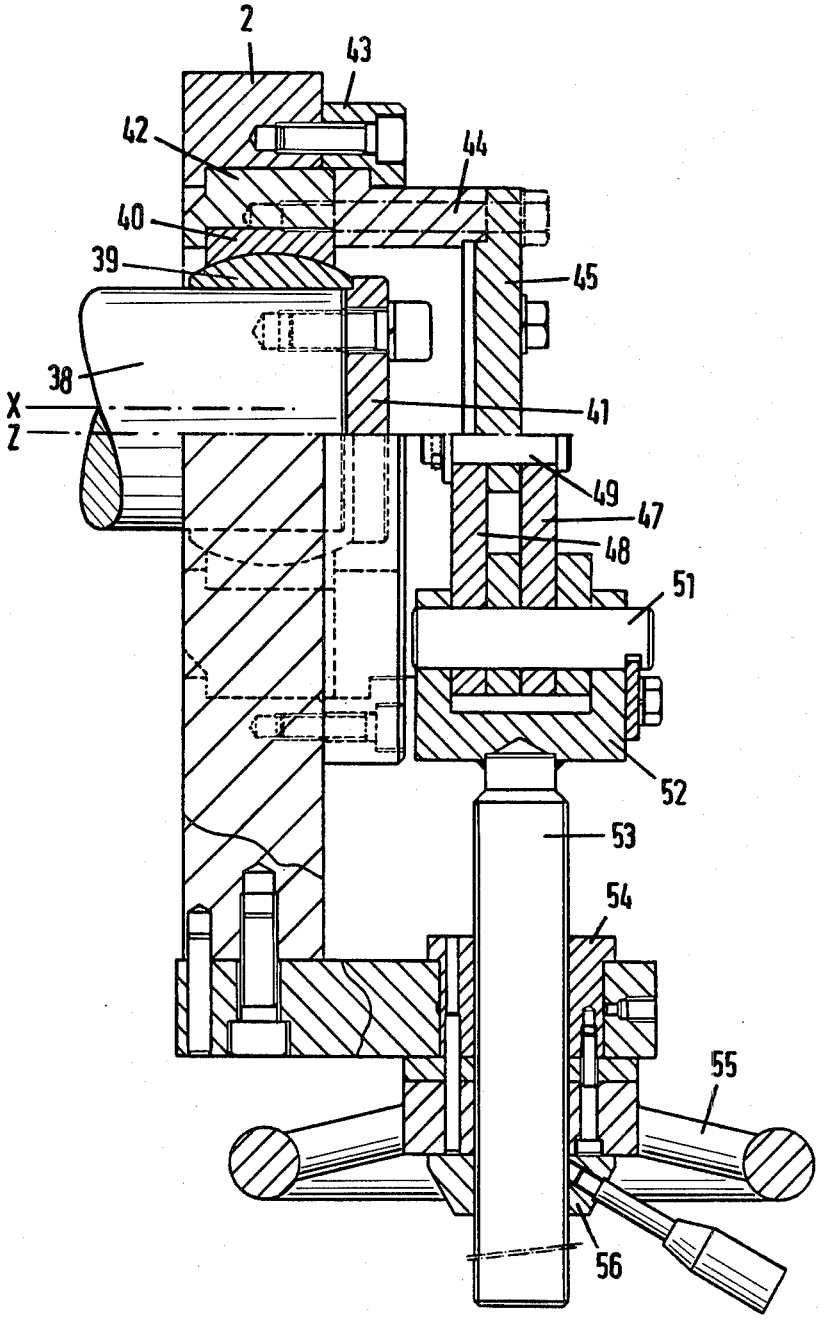
FIG. 7 is a cross-section on the line VII—VII of FIG. 6.

The operating mechanism 50 for tilting the swivel axle 38 and the corresponding shaft associated with the lower tool spindle 6 is shown in FIGS. 6 and 7. On the eccentric bearing brass 42 (see FIG. 7) there is provided a spacing ring 44 which is confined in axiale direction by a retaining plate 43 provided on the rear wall 2 of the frame. On said spacing ring 44 there is provided a plate 45 fitted with a projection 46 (see FIG. 6). The plates 45 for the upper and lower swivel axles are mounted in mirror-symmetrical relationship. On the projections 46 of the plates 45 there are provided respectively the links 47 and 48 which at 49 respectively 50 are pivotally connected to the projections 46 of the two plates 45. Opposite the pivots 49 respectively 50 the links 47, 48 are connected to a common pin 51. The pin 51 is received in a clip 52 to which is secured a threaded spindle 53 which is received in a threaded bush 54, which is rotatably received in a sidewall of the frame. On the threaded bush 54 there is secured a hand wheel 55 through which the threaded spindle 53 can be displaced in axial direction. On the threaded spindle 53 there is furthermore provided a locking washer 56 for securing the hand wheel 55 and hence the threaded spindle.

FIG. 6 shows the operating mechanism 50 in the mid-position, i.e. a position wherein the two tool spindles 5 and 6 occupy a purely horizontal position in the frame 1. By rotation of the hand wheel 55 in such a way that the threaded spindle 53 in the drawing moves downwardly, the two plates 45 and hence the interconnected eccentric bearing brasses 42 are rotated in opposite direction, while the ends of the axles 38 move towards each other and consequently will move the ends of the tool spindles 5, 6 away from each other. Upon rotation of the hand wheel in opposite direction, the threaded spindle 53 in the drawing moves upwardly, whereby the ends of the swivelling arm axles 38 move away from each other while the ends of the tool spindles 5,6 move towards each other through exactly the same angle. As already indicated in the above, there can thereby be obtained a compensation of the deflection of the tool spindles leading to a completely symmetrical formed rim.

The above-described swivelling arm construction has the additional advantage that the angular displacement of the swivel axle 38 is a measure for the path completed by the lower tool spindle 6 in vertical direction, under influence of the hydraulic cylinder 9. To obtain a rapid loading-unloading cycle and a timely switch-over from a high displacement speed of the lower tool spindle to a lower speed, to be maintained during the forming of the rim, the swivel axle 38, associated with the lower tool spindle 6, is provided with a stub shaft 60 (see FIG. 8) whereon a plurality of switch cams 61–63 are secured. During the rotation of the swivel axle and hence of the stub shaft 60, the cams 61–63 can be contacted with limit switches 64, 65 and 66 disposed in a suitable place, while the switch cam 61 in coaction with the limit switch 64 switches on e.g. the feed rate during the forming process, while the switch cam 62 in coaction with the limit switch 65 is adapted to switch on a higher positioning rate for lifting the lower tool spindle while the switch cam 63 in coaction with the limit switch 66 is likewise adapted to switch on an increased positioning rate, however, in downward direction.

The operating mechanism 50 will usually be adjusted in such a way that the rim forming tools provided on the tool spindles 5, 6 enclose an acute angle and face each other, for compensating the deflection of the tool spindles occurring during the forming. The operating mechanism 50, however, also has the possibility to diverge the forming tools positioned on the spindles 5 and 6, so that a compensation possibility is obtained in case of tool deviations.

I claim:

1. A rim forming apparatus, comprising a frame having upper and lower superimposed drivable and substantially vertically slidable spindles for applying thereon rim forming tools or rolls, the lower spindle being movable by means of a hydraulic cylinder relative to the upper spindle, while the upper spindle is tiltable in the plane through the two spindles for compensating for a deflection of the two spindles during the rim forming process, characterized by first and second swivelling arms, each having first and second ends, and each of the spindles carrying the rim forming rolls are received in the first end of a swivelling arm, with the second end of each swivelling arm being mounted in the frame, and each swivelling arm being rotationally supported in the frame by bearings, and the axis of the bearings of each swivelling arm being adjustable in the frame.

2. An apparatus according to claim 1, characterized in that the bearings of each swivelling arm comprises spherical portions, one of which is received in an eccentric bearing brass, while the other portion is mounted for axial movement in the frame.

3. An apparatus according to claim 2, characterized in that the eccentric bearing brasses of the two swivelling arms are provided at the end of the swivelling arm facing away from the rim forming roll.

4. An apparatus according to claim 3, characterized in that an operating mechanism is provided that is connected to both eccentric bearing brasses for simultaneously rotating the same in opposite direction.

5. An apparatus according to claim 4, characterized in that the operating mechanism comprises an axially displaceable lead screw, at one end of which there are provided two links which are pivotally connected respectively to the eccentric bearing brasses of the two swivelling arms, in such a way that upon axial displacement of the lead screw, both eccentric bearing brasses are adjusted through an identical angle.

6. An apparatus according to claim 5, characterized in that there is provided on the axle of a swivelling arm a series of switch cams the ends of which, upon rotation of the swivelling arm axle, are adapted to operate a series of limit switches, which limit switches are received in a control circuit for controlling the hydraulic cylinder associated with the lower tool spindle.

* * * * *